US005537974A

United States Patent [19]

Palmer

[11] Patent Number: 5,537,974

[45] Date of Patent: Jul. 23, 1996

[54] METHOD AND APPARATUS FOR USING EXHAUST GAS CONDENSER TO RECLAIM AND FILTER EXPANSION FLUID WHICH HAS BEEN MIXED WITH COMBUSTION GAS IN COMBINED CYCLE HEAT ENGINE EXPANSION PROCESS

[75] Inventor: William R. Palmer, Melbourne, Fla.

[73] Assignee: Spread Spectrum, Melbourne, Fla.

[21] Appl. No.: 315,100

[22] Filed: Sep. 29, 1994

[51] Int. Cl.[6] ..... F02B 53/00; F02G 3/00

[52] U.S. Cl. ..... 123/204; 123/236; 60/39.05; 60/39.55

[58] Field of Search ..... 123/204, 236; 60/39.05, 39.55

[56] References Cited

U.S. PATENT DOCUMENTS

| | | | |
|---|---|---|---|
| 3,038,308 | 6/1962 | Fuller | 60/39.55 |
| 3,747,573 | 7/1973 | Foster | 418/262 |
| 4,499,721 | 2/1985 | Cheng | 60/39.55 |
| 4,928,478 | 5/1990 | Maslak | 60/39.55 |

FOREIGN PATENT DOCUMENTS

| | | | |
|---|---|---|---|
| 4002506 | 5/1990 | U.S.S.R. | 123/204 |

*Primary Examiner*—Charles Freay

[57] ABSTRACT

A continuous combustion, pinned vane type, positive displacement, rotary compressor and expander engine system comprises a compressor which outputs compressed air, a combustor which effects continuous combustion of a combustion gas mixture containing fuel and compressed air and produces a combustion gas output. An expander is coupled to receive a mixture of combustion gas and an expansion fluid as an expandable working gas. The expander expands the expandable working gas and performs work to cause rotation of an engine output shaft. The engine system includes an expansion fluid flow path having an input port to which the expansion fluid is supplied, and an output port coupled to combine the expansion fluid with the combustion gas as the expandable working gas. The expansion fluid flow path is in thermal communication with the expander housing such that there is a thermal energy transfer from the housing to the expansion fluid, thereby increasing the thermal energy of the expansion fluid that has been supplied to the input port of the expansion fluid flow path, and is output from the output port for combination with the combustion gas as the expandable working gas. An expansion fluid condensation sub-system coupled in fluid communication with the exhaust manifold includes a heat exchanger and a condensation accumulator. Expansion fluid reclaimed in the condensation accumulator is recirculated to the expander.

25 Claims, 5 Drawing Sheets

METHOD AND APPARATUS FOR USING EXHAUST GAS CONDENSER TO RECLAIM AND FILTER EXPANSION FLUID WHICH HAS BEEN MIXED WITH COMBUSTION GAS IN COMBINED CYCLE HEAT ENGINE EXPANSION PROCESS

CROSS-REFERENCE TO RELATED APPLICATIONS

The present application is a continuation-in-part of my co-pending application Ser. No. 940,446 (hereinafter referenced as the '446 application), filed Sep. 4, 1992, entitled: "Rotary Compressor and Engine System," assigned to the assignee of the present application, and the disclosure of which is incorporated herein. It also relates to the subject matter of a new and improved continuous combustion, pinned vane type, positive displacement, rotary compressor and expander engine system, described in my co-pending application entitled: "Method and Apparatus for Transferring Heat Energy from Engine Housing to Expansion Fluid Employed in Continuous Combustion, Pinned Vane Type, Positive Displacement, Integrated Rotary Compressor-Expander Engine System, Increasing Energy Density of Expansion Fluid," filed coincident herewith, Ser. No. 08/315,103 (hereinafter referred to as the '103 application) assigned to the assignee of the present application, and the disclosure of which is also incorporated herein.

FIELD OF THE INVENTION

The present invention relates in general to rotary machines and, more particularly, to an exhaust gas condenser sub-system, that is installed in the exhaust gas flow path from the exhaust manifold of the expander of a continuous combustion, pinned vane type, positive displacement, rotary compressor and expander engine system, in order to reclaim and filter expansion fluid which has been mixed with combustion gas supplied to the expander.

BACKGROUND OF THE INVENTION

Positive displacement internal combustion engines (ICEs) typically do not inject steam or water as part of the expansion (power) stroke, due to the fact that the timing of the mixing process to achieve a satisfactory or optimal mix is extremely difficult and requires costly hardware components. Indeed, it has been found that systems that have purported to inject water or steam into the combustion gas require extremely precise timing and have proven to be unreliable over time. Since current engine systems do not include water as part of the expansion cycle, no provision is made to reclaim it.

In some combined cycle engine systems which do incorporate water as part of the expansion process, such as water injection in gas turbines, it may not be necessary to reclaim the water, in which case it is simply expelled to the atmosphere. Examples where such systems may be installed include ground-based power production facilities, or aircraft which use water injection during take-off, but do not wish to carry the added weight of an on-board water supply during flight.

On the other hand, in some applications, it is necessary to provide an available water supply for use as an expansion fluid and reclamation to the extent possible. Examples of these applications include remote facilities where water is relatively scarce, or transportation systems where the range of travel is limited by the volume of on-board storage. In such circumstances, reclamation of a portion of the water used in the expansion process is desirable, so that the total or net utilization of water from storage may be reduced. Using a simple example for a vehicle application, if the flow rate of water through the system is five gallons per hour, then in six hours of travel at sixty miles per hour (a 360 mile range), the vehicle requires a thirty gallon water storage capacity. Employing a reclamation sub-system that is capable of reclaiming 50% of the expansion water would reduce the storage requirement for the same three-hundred, sixty mile range to fifteen gallons which, in a variety of applications, especially a vehicle, as in the present example, is economically beneficial for a number of reasons.

First of all, reducing the storage capacity required for the expansion fluid reduces the overall weight of the vehicle. A reduction of fifteen gallons of water saves one hundred twenty pounds of weight, which improves both vehicle performance and efficiency. Secondly, reducing the quantity of water required means that a smaller volume storage container can be used. A third issue is the matter of cost. If the water to be supplied to the engine must be filtered, then it would be highly desirable to save the cost of an additional fifteen gallons per fill-up.

SUMMARY OF THE INVENTION

In accordance with the present invention, these objectives are met by means of a water reclamation sub-system that is installable in a continuous combustion, pinned vane type, positive displacement, rotary compressor and expander engine system, particularly of the type described in my coincidently filed application, referenced above, which sub-system is operative to reclaim and filter expansion fluid that has been mixed with combusted gas supplied to the expander.

More particularly, my above-referenced coincidently filed '103 application entitled: "Method and Apparatus for Transferring Heat Energy from Engine Housing to Expansion Fluid Employed in Continuous Combustion, Pinned Vane Type, Positive Displacement, Integrated Rotary Compressor-Expander Engine System, Increasing Energy Density of Expansion Fluid," discloses an augmentation of the continuous combustion, positive displacement, pinned vane compressor and expander rotary device described in my '046 application. In particular it discloses a thermal energy transfer medium sub-system, preferably in the form of an expansion fluid sub-system, which is thermally coupled with the expander housing, either directly, or indirectly, via an intermediate heat exchanger. This thermal energy transfer medium sub-system is operative to both absorb thermal energy from the expander housing, thereby raising the thermal potential energy of the medium, while simultaneously cooling the housing.

Using an expansion fluid such as water as the thermal energy transfer medium allows the expansion fluid to be employed as a constituent component of the working gas that is supplied to the expander, in particular to be combined with the combusted gas produced by the combustor, yielding a high temperature expandable gas that is delivered from the combustor to the expander. By incorporating such an expansion fluid augmentation sub-system, the continuous combustion, positive displacement, pinned vane compressor and expander heat engine configuration is capable of operating at temperatures considerably higher than a conventional internal combustion engine. The cooling effect imparted by the expansion fluid to the expander housing reduces part stresses and sealing requirements relative to those encountered in a conventional internal combustion engine.

As a non-limiting example, the incorporation of such a thermal energy transfer medium sub-system allows engine case temperatures to be maintained in the 500° F. temperature range, even though the temperature of the working gas being supplied to the expander is considerably higher (e.g., on the order of 1100° F.). In addition, the continuous combustion aspect of the expansion fluid-augmented engine system allows for the injection of steam at or just beyond the flame front of combustion, which eliminates the requirement for critical timing injection hardware and insures that the injection of steam will not extinguish or impede the combustion process.

Such an expansion fluid-augmented engine configuration is diagrammatically illustrated in FIG. 1 as comprising an integrated engine assembly 10, in which the fundamental rotary device architecture of each of a compressor 11 and expander 13 essentially corresponds to that of a rotary device described in the above-referenced '446 application. The compressor 11 and the expansion fluid-augmented expander 13 share a common rotating shaft 14. A combustor 15 is interposed between the compressor 11 and the expander 13. Also employed are a starter/generator 17 and a timing gear assembly 19, which are housed in the integrated assembly with the compressor, combustor and expander. The rotary device of the compressor takes in fresh air, compresses that air and supplies the preheated compressed air to the combustor. In the combustor, the compressed air is mixed with a combustible fluid, combusted, and then output as an expandable working gas to the expander, wherein the working gas is expanded and used to perform work and rotate the engine output shaft 16.

For this purpose, the compressor has an outer housing, which is configured to be integral with a compressible fluid (e.g. air) inlet passageway through which ambient air is drawn from an air inlet port for application to an interior compression chamber. The compressor's interior chamber is ported into an inlet passageway of the combustor. Thus, ambient air that has entered the interior chamber of the compressor is compressed during rotation of the inner hub of the compressor about the central axis of its interior chamber, and associated rotation of the outer hub assembly, and then supplied as pressurized pre-heated air to the combustor, wherein the compressed air is mixed with fuel and burned.

The combusted air is combined with expansion fluid from the expansion fluid augmentation sub-system of the expander and the resulting combined expandable working gas is injected at a substantially elevated temperature. Where water is employed as the expansion fluid, the thermal energy transfer from the expander housing to the expansion fluid converts the water from a liquid state to a gaseous state (e.g. steam), where the latent heat of vaporization consumes a prescribed quantity of thermal energy per unit volume of expansion fluid (per pound of water). Once the gas has expanded and performed work in rotating the engine output shaft, it is ported to an expander exhaust manifold.

Pursuant to the present invention, the configuration of the compressor is augmented to provide a heat exchanger and expansion fluid reclamation sub-system, which is disposed in the flow path of the exhaust gas from the expander exhaust manifold. Cooler ambient air being drawn into the compressor is used to lower the temperature of the exhaust gas mixture leaving the expander, so as to enhance (accelerate) condensation of the expansion fluid (water).

Namely, as the exhaust gas cools, water vapor in the exhaust gas condenses in a collector, so that the water may be reclaimed for further use in the expander.

The heat exchanger effects a convective thermal transfer between the exhaust gas and the ambient intake air, thereby preheating the intake air to the compressor, and cooling the exhaust gas. The heat exchanger has a first inlet port opening into a heat exchanger chamber, in which a heat exchange element is installed. In a non-limitative embodiment, the heat exchange element may be configured of a section of wide diameter thermally conductive tubing that extends in a first direction between an ambient air inlet port and a first output port. The heat exchanger further contains a plurality of thermal exchange tubes that extend generally transverse to the length of the heat exchanger element, so as to allow exhaust gas supplied via the exhaust manifold of the expander to pass therethrough and be vented to the atmosphere through an exhaust gas outlet port. Advantageously, the size and configuration of the heat exchanger facilitates large volumetric flow rates of ambient air to the compressor, so that oxygen density does not become a problem in providing for a lean burn combustion process in the combustor.

As the exhaust gas flowing through the expander exhaust manifold passes through the thermal exchange tubes of the heat exchanger, there is a convective thermal transfer between the exhaust gas and the thermally conductive material of the heat exchange element. In turn, there is a further convective thermal transfer between the heat exchange element and the ambient air being supplied to ambient air inlet port, so that heat from the heat exchanger is transferred to the ambient air being draw in to the compressor, thereby increasing the temperature of the intake ambient air to the compressor. At the same time the lower temperature of the intake air serves to cool the surfaces of the heat exchanger.

The convective thermal transfer between the exhaust gas and the thermally conductive material of the heat exchange element causes condensation of the expansion fluid (water droplets in the case of using water/steam as the expansion fluid) on the interior of the heat exchanger as the exhaust gas cools. This water condensation is collected by a condensation accumulator/sump installed at a downstream region of the heat exchanger adjacent to the exhaust gas outlet port. A condensation pump is coupled to a condensation removal line that is ported to the bottom of the sump, so that accumulated water condensation may be removed via a feed water supply line. This feed water supply line is coupled to a water recirculation system so as to be fed back to the expansion fluid inlet port of the expander, thereby allowing the expansion fluid to be reclaimed for reuse and thereby reduce the total or net utilization of water from an associated expansion fluid storage facility.

DETAILED DESCRIPTION

Figure 1:
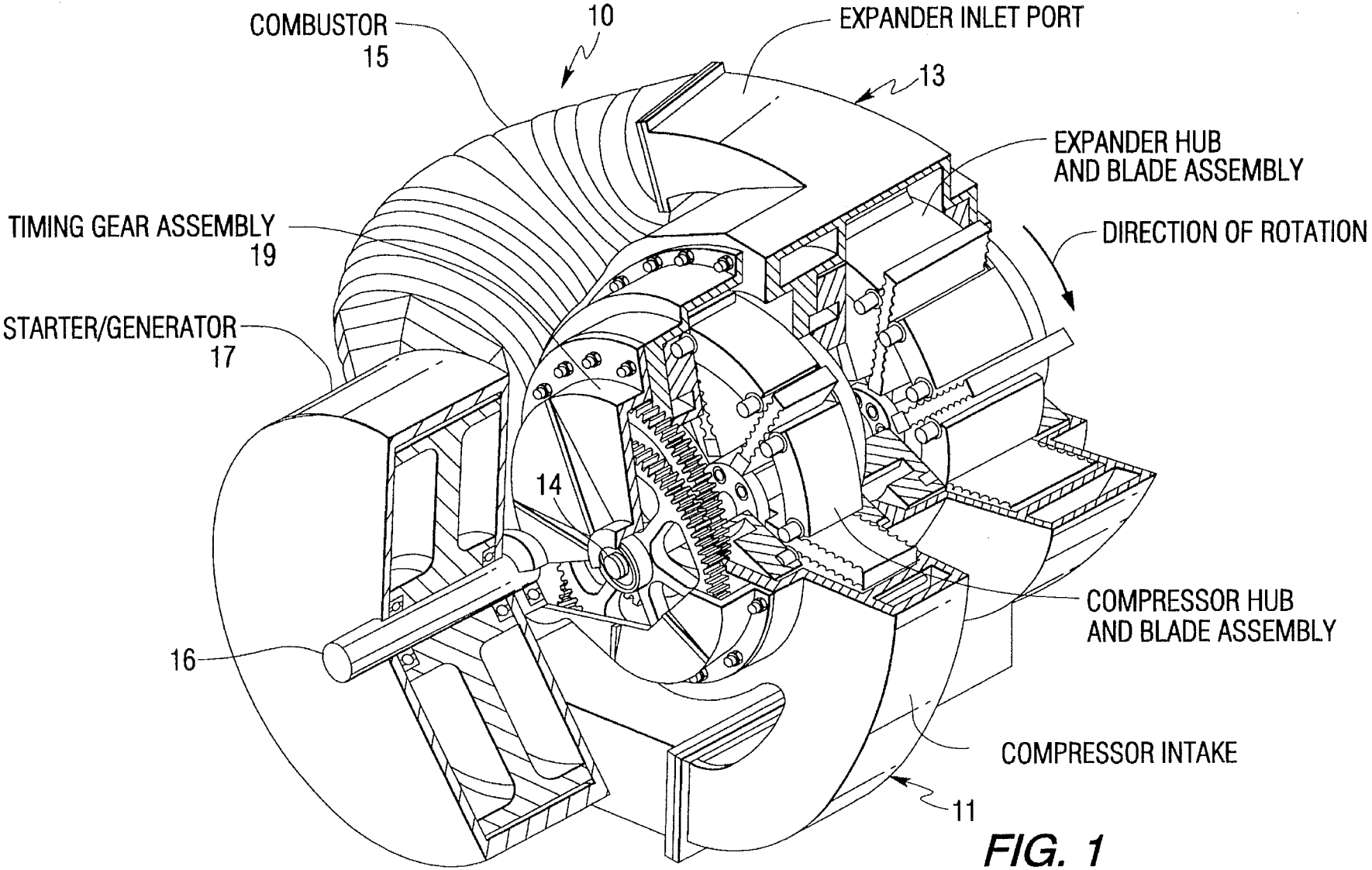
FIG. 1 diagrammatically illustrates an expansion fluid-augmented continuous combustion, pinned vane type, positive displacement, rotary compressor and expander engine system of the type described in the above-referenced coincidently filed application Ser. No. 08/315,103.
Figure 2:
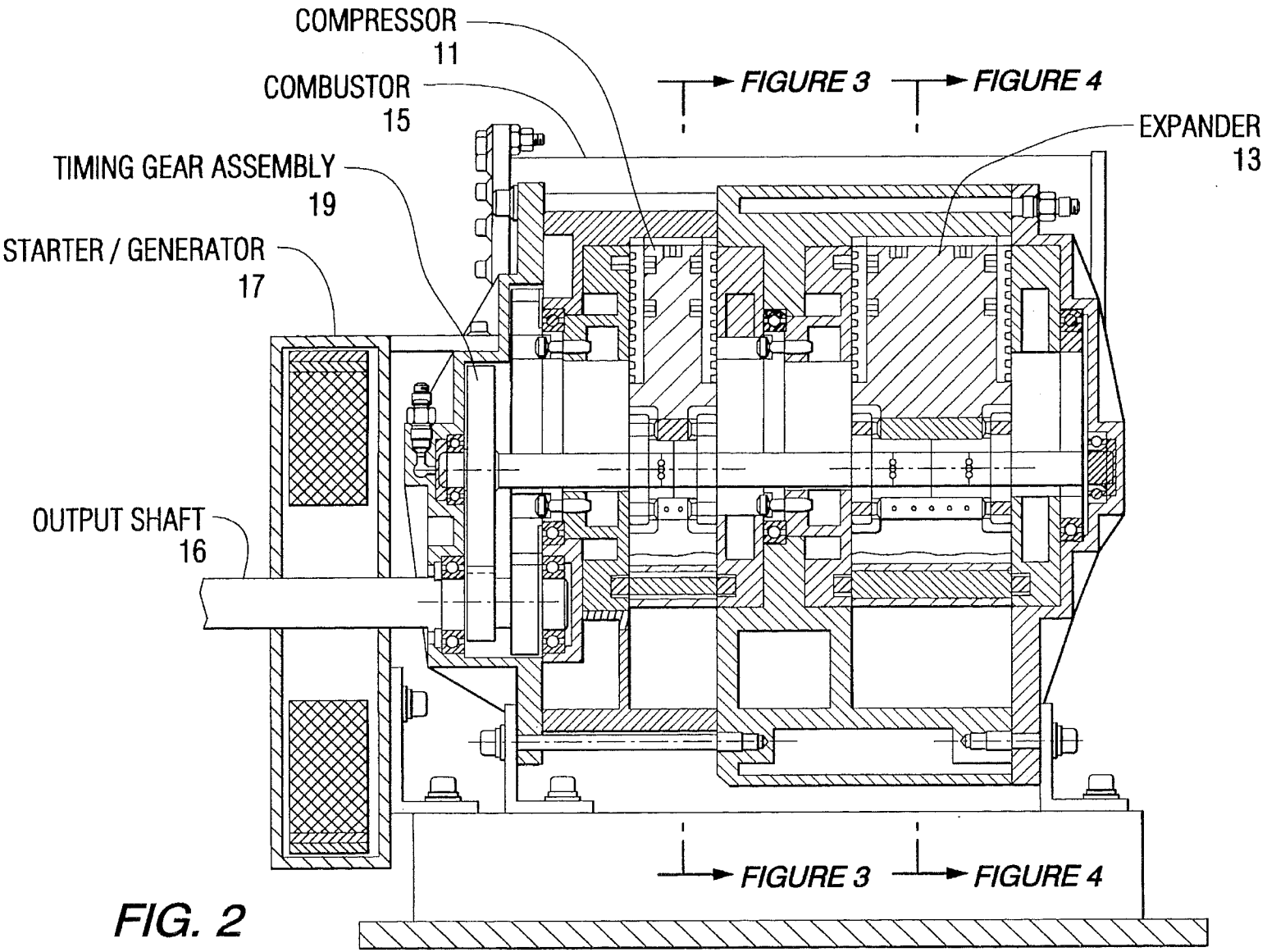
FIG. 2 is a diagrammatic cross-sectional illustration of the engine system of FIG. 1.
Figure 3:
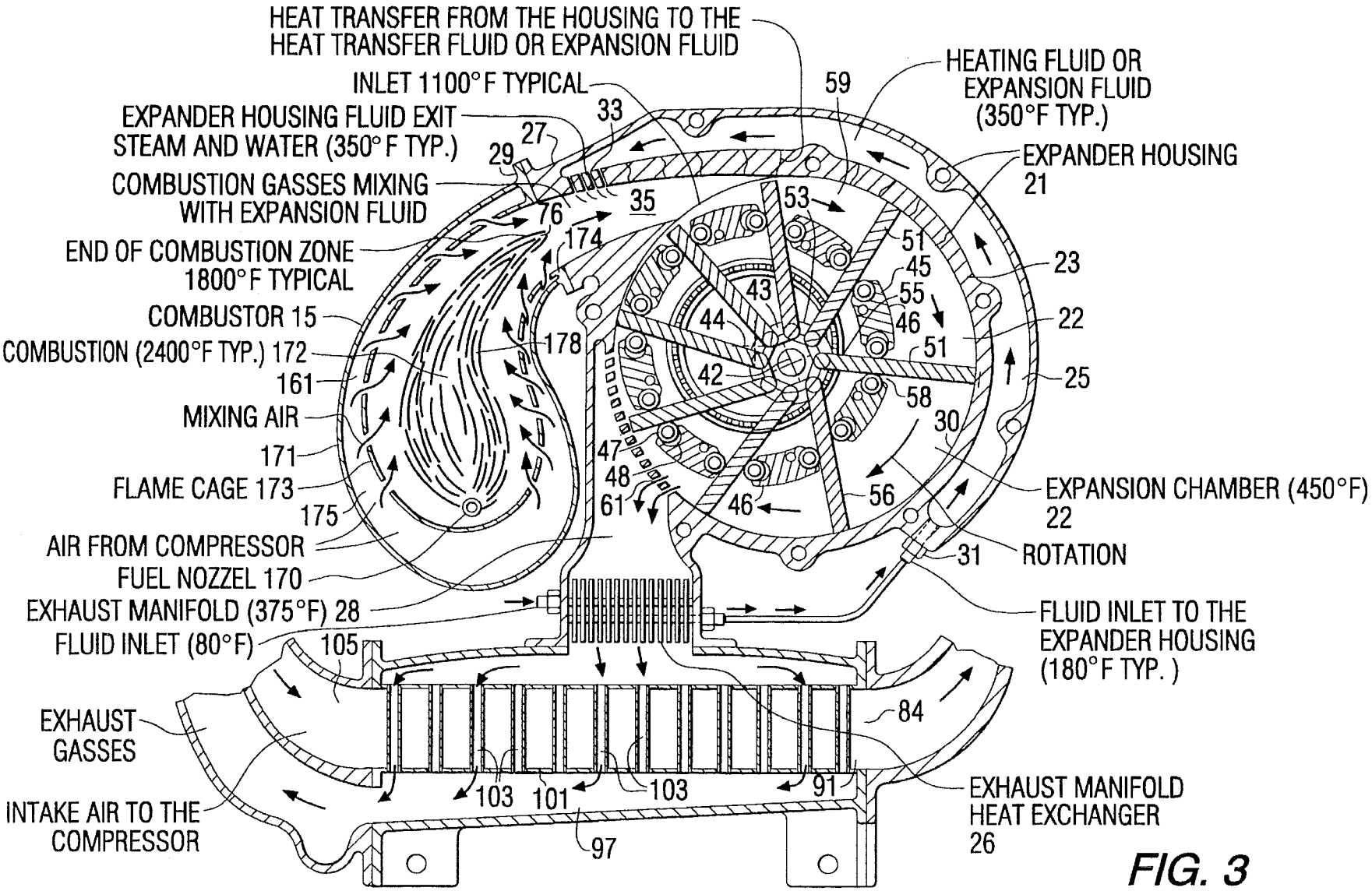
FIG. 3 is a sectional view of the expansion fluid sub-system-augmented expander taken along lines 3—3 of FIG. 2.
Figure 4:
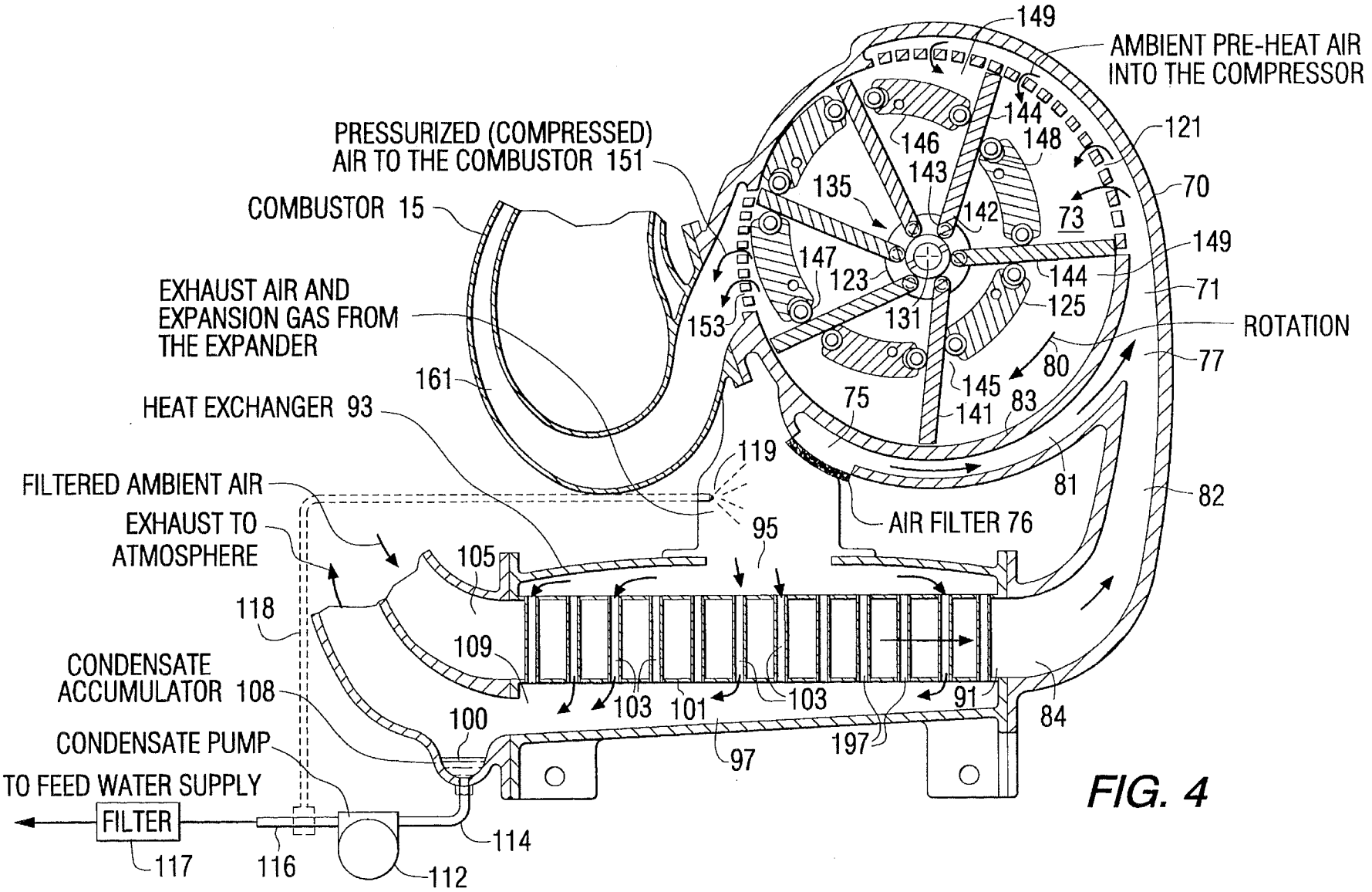
FIG. 4 is a sectional view of the compressor taken along lines 4—4 of FIG. 2.

Attention is now directed to FIGS. 2–4, in which FIG. 2 is a diagrammatic cross-sectional illustration of the engine system of FIG. 1, FIG. 3 is a sectional view of the expansion fluid subsystem-augmented expander 13 taken along lines 3—3 of FIG. 2, and FIG. 4 is a sectional view of the compressor 11 taken along lines 4—4 of FIG. 2.

More specifically, as shown in FIG. 3, the expander 13 comprises an outer housing 21, which is configured to be integral with and form a wall 23 of a thermal transfer fluid (expansion fluid, such as water) passageway 25 and surrounds an interior expansion chamber 22. Thermally conductive wall 23 of expansion fluid passageway 25 extends to a coupling port 27 to which an outlet port fitting 29 of combustor 15 is joined. Expansion fluid passageway 25 serves to provide a circulation path for a heat transfer medium, such as water, in contact with the thermally conductive wall 23 of the expander housing 21. Through conduction, the temperature of a heating or expansion fluid (e.g. water), that has been injected at an expansion fluid inlet port 31, is elevated by thermal flow through the wall 23 of the expander housing 21. Prior to being injected into expansion fluid passageway 25 via inlet port 31, the expansion fluid is preheated via a heat exchanger 26 located in the expander's exhaust manifold 28.

Adjacent to coupling port 27, wall portion 23 of heating fluid, expansion fluid passageway 25 has one or more apertures 33 that communicate with a mixing inlet throat portion 35 to the interior working fluid expansion chamber 22 of the expander 13. Within this throat portion 35, heat expansion fluid (e.g. superheated steam) that has been injected from expansion fluid passageway 25 mixes with combustion gases from the combustor 15, and the combined working gas is injected at a substantially elevated temperature (e.g. on the order of 1100° F.) into the interior expansion chamber 22 of the expander 13.

The rotary device configuration of the expander, like that of the compressor (to be described below with reference to FIG. 4), has an inner hub 43 and an outer hub assembly 45. The inner hub 43 rotates about a central first axis 42 of chamber 22, while the outer hub assembly 45 rotates about a second axis 44 that is offset from the central first axis 42. The inner hub 43 is mechanically linked with the outer hub assembly 45 by way of a gear arrangement (not shown in FIG. 3).

A plurality of blades 51 are pivotally attached at respective axes 53 passing through the outer hub assembly 45 at a first, radially interior end 55 of each of the blades 51, so that the blades 51 may rotate about these respective axes 53 of inner hub 43. Second, radially outer portions 56 of the blades pass through slots 58 in the outer hub assembly 45, which slots are formed between respective blade spreader elements 46.

Located in a generally cylindrical slot 48 of each blade spreader element 46 is a cylindrical roller element 47. Via a spring-biased translatable seal (not shown) captured in a slot 48 and urged against roller element 47, together with a blade pivot insert, the cylindrical roller element 47 is continuously physically biased against a side surface of a blade 51, thereby providing a pivotal seal at each slot 48. Such a biased sealing arrangement is preferably configured in the manner described in co-pending application Ser. No. 08/315,095, entitled: "Blade Sealing Arrangement for Continuous Combustion, Positive Displacement, Combined Cycle, Pinned Vane Rotary Compressor and Expander Engine System," filed coincident herewith, assigned to the assignee of the present application, and the disclosure of which is incorporated herein. Such a blade sealing arrangement allows blades 51 to be sealingly engaged by the spreader elements 46 of the outer hub assembly 45 at different locations and thereby different angles, in accordance with the offset location of the inner hub 43 relative to central axis 42.

In operation, since the first radially interior end 55 of a blade 51 engages the inner hub 43, then, with the radially outer portion 56 of each blade 51 passing through slot 58 in outer hub assembly 45 to the interior surface 30 of the interior chamber 22, as the working gas expands and pushes against the blades 51 the outer hub assembly 45 is rotated about axis 44, in turn rotating the inner hub 43 about axis 42 and rotating engine output shaft via timing and gear assembly 19. Namely, as the expander blades 51 rotate, successive compartments 59 of the expansion chamber 22 containing the working gas increase in volume and thereby allow the gas to expand, and eventually exit exhaust port apertures 61 into exhaust manifold 28.

As described previously, the exhaust manifold of the expander is coupled to a heat exchanger and expansion fluid reclamation sub-system. Heat from the exhaust gas leaving the expander housing is first used by the exhaust manifold heat exchanger 26 to effect a thermal transfer between the heat exchanger and the expansion fluid in the heat exchanger 26. Second, ambient air being supplied to the air inlet port of the compressor is convectively heated by thermal transfer of the exhaust gas after passing through the exhaust manifold heat exchanger 26, thereby pre-heating intake air to the compressor and removing heat from the exhaust gas allowing water to be reclaimed.

Referring now to FIG. 4, the structure of the compressor 11 is diagrammatically illustrated as comprising an outer thermally conductive housing 70, which is configured to be integral with a compressible fluid inlet passageway 71 through which a compressible fluid (e.g. air) is drawn for application to an interior compression chamber 73, disposed within outer housing 70. Fluid inlet passageway 71 has a first portion 81, which extends along an outer solid wall region 83 of interior chamber 73 from a first air inlet port 75 to an intersection region 77 of fluid inlet passageway 71. An air filter element 76 is installed at air inlet port 75.

Within the rotary device structure of the compressor 11, fluid inlet passageway 71 has one or more apertures 121 distributed along a circumferential sub-portion of interior chamber 73, so that pre-heated ambient air may enter the interior chamber 73. As in the rotary device configuration of the expander of FIG. 3, described above, the compressor structure of FIG. 4 has an inner hub 123 and an outer hub assembly 125. The inner hub 123 rotates about a central first axis 131 of interior chamber 73, while the outer hub assembly 125 rotates about a second axis 135 that is offset from the central first axis 131. The inner hub 123 is mechanically linked with the outer hub assembly 125 by way of a gear arrangement (not shown in FIG. 4).

A plurality of blades (vanes) 141 are pivotally attached through respective axes 143 passing through a first, radially interior end 142 of each of the blades 141 at the inner hub 123, so that the blades 141 may rotate about these respective axes 143. Second, radially outer portions 144 of the blades 141 pass through slots 145 in the outer hub assembly 125, which are formed between respective blade spreader elements 146. Each blade spreader element 146 has cylindrical roller elements 147 that are accommodated in generally cylindrical slots 148 in the spreader element.

As in the expander, a spring-biased translatable seal is captured in slot 148 and is urged against roller element 147, so that the cylindrical roller element 147 is continuously physically biased against a side surface of a blade 141, providing a pivotal seal at each slot 148. The first radially interior portion 142 of a respective blade 141 engages the inner hub 123, such that rotation of the inner hub 123 about the first central axis 131 drives this first radially interior portion 142 of each blade 141 about the central axis 131. Since the second, radially outer portion 144 of each blade 141 passes through the outer hub assembly 125 to the interior surface 83 of compression chamber 73, rotation of the outer hub assembly 125 about the second axis 135 drives the second, radially outer portion 144 of each blade 141 about the first axis 131.

With inner hub 123 and outer hub assembly 125 being coupled through a mutual gearing arrangement, then as the blades 141 rotate during rotation of the inner hub about central axis 131 and the outer hub assembly 125 about the second axis 135, the blades 141 depart from extending radially about the central axis 131. This departure of the blades 141 from the radial direction forms a plurality of different volume, relatively airtight compartments 149 between the interior surface 83 of compression chamber 73, the outer hub assembly 125, and respective pairs of blades 141. The volume of each compartment 149 varies as a function of rotative position around the central axis 131.

A further sub-portion 151 of housing 70, which is spaced apart from the circumferential sub-portion containing apertures 121 that communicate with fluid inlet passageway 71, has a plurality of apertures 153, through which (preheated) compressed air produced by the compressor is ported into an inlet passageway 161 of combustor 15. Thus, pre-heated ambient air that has entered the interior chamber 73 of the compressor 11 is compressed during rotation (clockwise, as shown by arrow 80) of the inner hub 143 about central axis 131 of interior chamber 73, and associated rotation of the outer hub assembly 125 about axis 135, and supplied as pressurized pre-heated air to the compressed air inlet passageway 161 of combustor 15.

Pursuant to the present invention, the fluid inlet passageway 71 of compressor 11 has a second portion 82, which extends from intersection region 77 with first portion 81 along the outer solid wall region 83 of interior chamber 73 to a second air inlet port 84 that engages a first outlet port 91 of a heat exchanger 93 of the expansion fluid reclamation sub-system.

As a non-limiting example, heat exchanger 93 has a first expander exhaust gas inlet port 95 that communicates with the exhaust manifold 28 of the expander 13, and opens into an interior chamber 97, in which a heat exchanger element 101 is installed. As described briefly above, heat exchanger element 101 may comprise a section of thermally conductive tubing that extends between a filtered air inlet port 105 and port 84 of the second portion 82 of compressor passageway 71, and containing a plurality of thermally conductive tubes 103, oriented transverse to the inlet air flow path from port 105 to port 84. Thermally conductive tubes 103 provide an exhaust gas flow path from a heat exchanger exhaust gas inlet port 95 to the lower side of interior chamber 97 as viewed in FIG. 4. Filtered ambient air enters through port 105 and passes over the thermally conductive tubes 103 that extend generally vertically over the length of the section of thermally conductive tubing so as to allow exhaust gas supplied the exhaust manifold 28 from the expander 13 to pass therethrough and be vented to a second outlet port 109. As noted earlier, the number of thermally conductive tubes 103 combined with the diameter of the heat exchanger tubes 103 facilitates large volumetric flow rates of exhaust gas to be ported from chamber 97 and then exhausted to the atmosphere. As shown, the plurality of heat exchange tubes 103 are spaced to allow large volumetric flow rates of ambient air to the compressor 11, so that oxygen density does not become a problem in providing for a lean burn combustion process in the combustor 15.

In operation, as the exhaust gas (including expansion water vapor) in expander exhaust manifold 28 passes through thermal exchange tubes 103 of heat exchanger element 101, there is a convective thermal transfer between the exhaust gas and the thermally conductive material of the heat exchange tubes 103, so that thermal energy from the exhaust gas is transferred to the heat exchanger element 101, thereby cooling the exhaust gas. In addition, there is a further convective thermal transfer between the heat exchanger element 101 and the ambient air being supplied to air inlet port 105, so that heat from the heat exchanger element 101 is transferred to the ambient air being draw in to the compressor via passageway 71, thereby increasing the temperature of the intake air.

The convective thermal transfer between the exhaust gas from exhaust manifold 28 and the thermally conductive material of the heat exchanger element 101 causes condensation of the expansion fluid (water droplets in the case of using water/steam as the expansion fluid) on the interior of the heat exchanger 93, as the exhaust gas cools. This water condensation 100 is collected by a condensation accumulator or sump 108 installed at a downstream region of heat exchanger 93 adjacent to second outlet port 109. A condensation pump 112 is coupled to a condensation removal line 114, that is ported to the bottom of the sump 108, so that accumulated water condensation 100 may be removed via a feed water supply line 116. A filter 117 is coupled with feed water supply line, so that as the water condenses and is pumped out, it passes through filter 117 to remove any contaminants that might be associated with combustion and any residue associated with the engine lubrication system. Feed water supply line 116 is coupled in an expansion fluid recirculation path so as to be recirculated through the exhaust manifold heat exchanger 26 and then to the expansion fluid inlet port 31 of the expansion fluid passageway 25 of expander 13, thereby enabling the expansion fluid to be reused, so as to reduce the total or net utilization of water from an associated expansion fluid storage facility.

The use of a high volume of intake air to cool the exhaust gas (and preheat the intake air) described above is capable of condensing out nominally fifty percent of the water contained in the exhaust gas mixture. Condensation rates are highly dependent upon a number of variables including, but not limited to the temperature of the ambient air, the percentage of water in the exhaust gas, the temperature of the exhaust gas, the heat transfer capability of the materials used in the heat exchanger and the operating conditions of the engine (engine speed).

Referring again to FIG. 3, the structure of combustor 15 is diagrammatically shown as comprising an outer housing wall portion 171, and an interior flame cage 173, each integrally formed with outlet port fitting 174, and defining compressed air inlet passageway 161. Combustor flame cage 173 has a plurality of openings 175 through which compressed air supplied by the compressor 11 into passageway 161 enters the flame cage 173 and is mixed with combustion fuel injected by way of a fuel nozzle 170. Via an igniter element (not shown) the fuel/compressed air mixture is ignited to produce continuous combustion within the flame cage 173 and producing an extremely hot (e.g. on the order of 2400° F.) core 172 within a combustion zone 174. At an end region 176 of combustion zone 174 adjacent outlet port fitting, the temperature of the combustion gas is still considerably elevated (e.g. on the order of 1800° F.).

Figure 5:
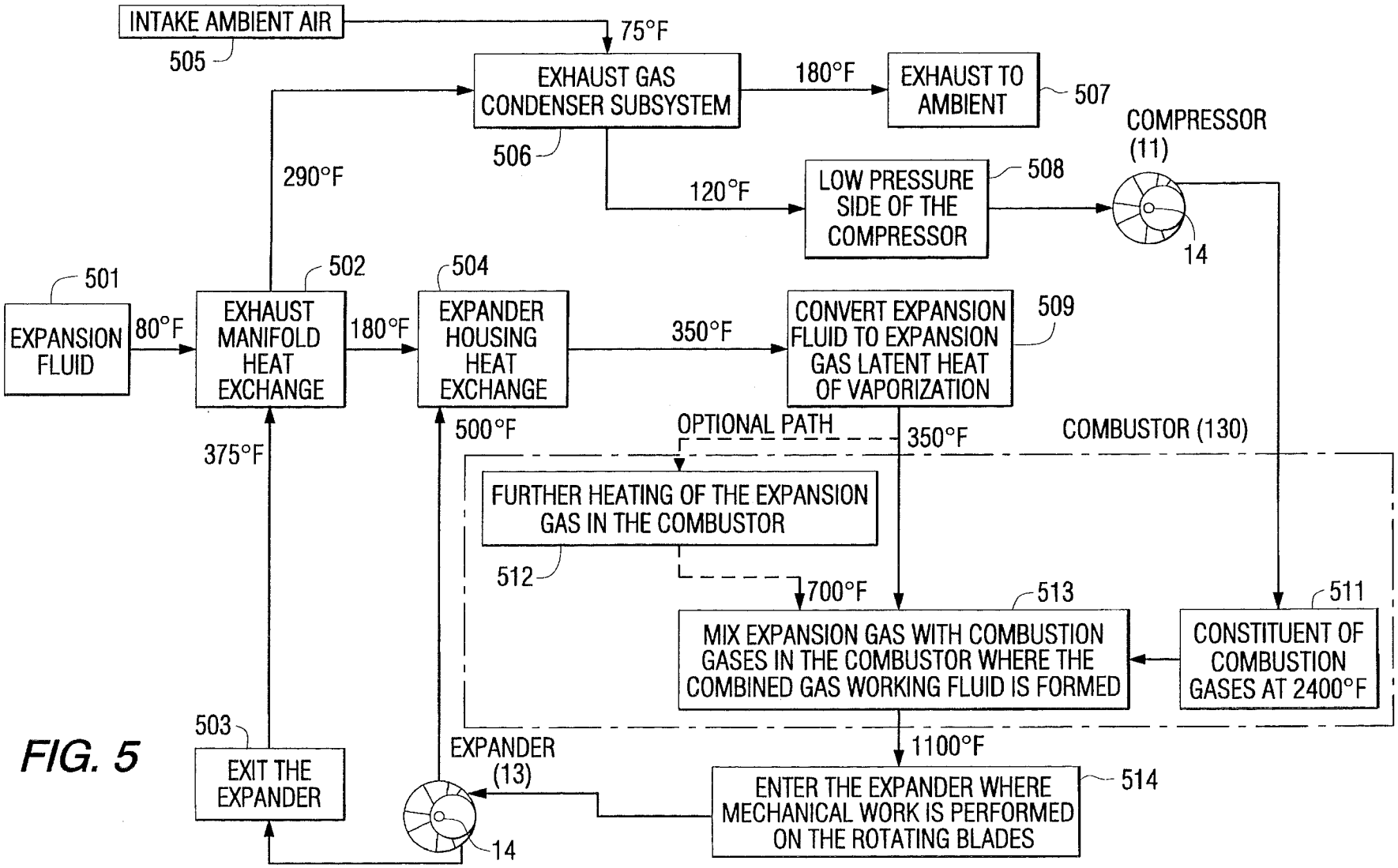
FIG. 5 is a process flow diagram, which diagrammatically illustrates the operation of the engine system of FIGS. 1–4.

FIG. 5 is a process flow diagram, which diagrammatically illustrates the operation of the engine system described above. At step 501, expansion fluid (e.g. water at an outside ambient temperature on the order of 80° F.) is supplied to heat exchanger 26 located in the exhaust manifold 28 of expander 13. At step 502, the expansion fluid is conductively heated by the heat exchanger (e.g. raised to a temperature on the order of 180° F.) by the convective transfer of heat energy in the exhaust gas (temperature on the order of 375° F.) in the exhaust manifold 28 to the heat exchanger elements containing the expansion fluid.

At step 504, as the heating/expansion fluid travels through fluid passageway 25 surrounding the interior chamber of the expander housing 21, the expander housing is cooled by the heat exchange with the circulating expansion fluid, which operates to elevate the temperature of the expansion fluid (to a steam temperature on the order of 350° F., for example) and maintains the temperature of the housing at a relatively steady value (e.g., on the order of 500° F.). As shown at step 509, this thermal energy transfer effectively converts the expansion fluid in fluid passageway 25 of the expander from a liquid state to a gaseous state (e.g. steam), where the latent heat of vaporization consumes a prescribed quantity of thermal energy per unit volume of expansion fluid (per pound of water).

In the compressor 11, ambient air at step 505 (e.g. at a nominal temperature of 75° F.) is supplied to the air inlet port of the heat exchanger 93. In step 506, as air is drawn into the heat exchanger 93, it is preheated by the exhaust gas (now at a temperature on the order of 290° F.) entering the heat exchanger via the exhaust manifold 28 of the expander 13. The temperature of the preheated compressed inlet air is now on the order of 120° F. As the exhaust gas in the exhaust manifold 28 passes through heat exchanger 93 (which is the gas condenser sub-system at 506) and preheats the ambient air, there is reduction in the temperature in the exhaust gas (e.g. to a value on the order of 180° F.), as the exhaust gas is exhausted at step 507 to the atmosphere through the heat exchanger outlet port.

At step 508, the preheated air enters the fluid inlet passageway of the compressor 11 and is supplied therefrom into the compressor's gas compression chamber. Then, as described earlier, during rotation of the compressor's inner hub and associated outer hub assembly, pressurized preheated air is supplied to the compressed air inlet passageway of the combustor 15.

Within the combustor 15, pressurized pre-heated air from the compressor 11 is supplied to the compressed air inlet passageway of the combustor 15. This preheated compressed enters the combustor flame cage 173, mixed with injected combustion fuel, and the fuel/compressed air mixture is ignited to produce continuous combustion within the flame cage and producing an extremely hot combustion temperature (e.g. on the order of 2400° F.), as shown at step 511. At the downstream end of the combustor adjacent to its outlet port fitting, and immediately upstream of the throat portion of the expander, the temperature of the combustion gas is still considerably elevated (e.g. on the order of 1800° F.), so that it has substantial thermal energy to be applied to the expansion fluid within the throat portion of the expander.

As an optional embodiment of the invention the expansion fluid may be ported in closed circulating tubes (not shown) around or within the flame cage 173 of the combustor 15, where there is further superheating of the expansion gas as shown in optional step 512 (e.g. to a temperature on the order of 700° F.). The expansion fluid then is injected into the inlet throat portion 35 of the expander. Then, at step 513, within inlet throat portion 35, the superheated steam mixes with combustion gases from the combustor 15, and the combined gas is injected at a substantially elevated temperature (e.g. on the order of 1100° F.) into the gas expansion chamber of the expander 13.

Once it has entered the gas expansion chamber of the expander 13, the mixed gas working fluid expands and causes rotation of the blades and shaft 14 of the expander and thereby driving engine output shaft 16 (step 514). During this expansion process, the temperature of the working gas in the interior chamber of the expander drops (e.g. to about 475° F.), as work is performed and the output shaft 14 is driven. The expanded working fluid then exits to the exhaust manifold 28 at a temperature of about 375° F.

Although water has been described as one type of expansion fluid that can be used, a derivative of water or other fluid with similar characteristics may be employed. The expansion fluid may flow through a path that is in direct contact with the engine housing, or it may flow through a secondary heat exchanger system, such as those described in the above-referenced coincidently filed engine system application.

In addition, to increase the efficiency of the condensation process, the above-described system may be modified to include an auxiliary water feed line shown in FIG. 4 by broken lines 118, coupled to feed water supply line 116. This auxiliary water feed line 118 may be coupled to a spray nozzle or atomizer 119 installed near the exit of the expander exhaust manifold 28. The spray nozzle 119 is operative to spray a portion of water into exhaust gas and thereby accelerate cooling of the exhaust gas and thereby condensation of water from the exhaust gas. The total water content of the condensate (exhaust gas condensate and mist condensate) is then collected in condensation sump 108, and pumped by condensation pump 112 through feed water supply line 116, so as to be recirculated through the system.

In accordance with a further embodiment of the invention, a heat pump system similar to an air conditioner may be used. In such a configuration, an auxiliary compressor pump (similar to the air compressor pump of a typical automobile application) may be attached to and driven by the output shaft of the system described. The hot side (compressed gas side) of the system is then cooled by the ambient air, either flowing into the heat exchanger element, or cooled independently by ambient air and a fan. The expanding gas side (or cool side) may be located in the exhaust gas stream between exit port 109 and open area 97. Here further cooling of the exhaust gas is afforded, thereby accelerating the condensation process and increasing the percentage of condensate being returned to the accumulator 108. This system may be multi-functional in many applications providing a heating source or cooling source for controlling user environmental conditions associated with the end product use of the system described herein.

As will be appreciated from the foregoing description, the present invention provides a water reclamation sub-system that is installable in a continuous combustion, pinned vane type, positive displacement, rotary compressor and expander engine system, particularly of the type described in my above-referenced coincidently filed application, which is operative to reclaim and filter expansion fluid that has been mixed with combusted gas supplied to the expander. As described above, the heat exchanger and expansion fluid reclamation sub-system is disposed in the flow path of the exhaust gas from the expander exhaust manifold and uses the heat in the exhaust gas to preheat intake ambient air to the compressor. As the intake air is heated by the thermal energy being removed from the exhaust gas, the exhaust gas cools, causing water vapor in the exhaust gas to condense in a collector, so that it may be reclaimed for further use in the expander.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. An engine system comprising a compressor which is operative to receive intake air and output compressed air, a combustor which is operative to effect continuous combustion of a combustion gas mixture containing fuel and said compressed air and produce a combustion gas output, and an expander to which a mixture of said combustion gas and an expansion fluid is supplied as an expandable working gas, said expander being operative to expand said expandable working gas and perform work which causes rotation of an engine output shaft, said expander having an expander housing including an exhaust manifold through which expanded gas is exhausted, each of said compressor and said expander comprising a respective pinned vane type, positive displacement, rotary device, and wherein said engine system further includes an expansion fluid flow path having an input port to which said expansion fluid is supplied, and an output port coupled to combine said expansion fluid with said combustion gas as said expandable working gas, said expansion fluid flow path being in thermal communication with said expander housing such that there is a thermal energy transfer from said housing to said expansion fluid, thereby increasing the thermal energy of said expansion fluid that has been supplied to said input port of said expansion fluid flow path, and is output from said output port for combination with said combustion gas as said expandable working gas, and further including an expansion fluid condensation sub-system in fluid communication with said exhaust manifold and coupled to receive said intake air, said expansion fluid condensation sub-system being operative to reclaim a portion of expansion fluid contained in said exhaust gas and to supply reclaimed expansion fluid to said expander.

2. An engine system according to claim 1, wherein said expansion fluid contains water.

3. An engine system according to claim 1, wherein said expansion fluid condensation sub-system includes a heat exchanger having an ambient air inlet port coupled to receive intake ambient air, and an air outlet port coupled to said compressor, an exhaust gas inlet port coupled with said exhaust manifold, and an exhaust gas outlet port, and an expansion fluid condensation accumulator arranged to collect expansion fluid condensed out of said exhaust gas by said heat exchanger.

4. An engine system according to claim 3, wherein said expansion fluid condensation sub-system further includes a condensation pump and a reclaimed expansion fluid supply line coupled between said condensation accumulator and said expander and being operative to recirculate reclaimed expansion fluid to said expander.

5. An engine system according to claim 4, wherein said condensation accumulator includes a sump installed at a downstream region of said heat exchanger, and wherein said condensation pump is coupled to said sump, so that accumulated expansion fluid condensation may be recirculated via said reclaimed expansion fluid supply line to said expander.

6. An engine system according to claim 4, wherein said reclaimed expansion fluid supply line is coupled with a filter which is operative to remove contaminants from expansion fluid being recirculated from said condensation accumulator to said expander.

7. An engine system according to claim 3, wherein said heat exchanger comprises a section of thermally conductive tubing that extends between said expander exhaust inlet port and said exhaust gas outlet port, said section of thermally conductive tubing containing a plurality of thermal exchange passageways that extend generally vertically and allow exhaust gas from said exhaust manifold to pass therethrough and be vented to said exhaust gas outlet port.

8. An engine system according to claim 4, wherein said expansion fluid condensation sub-system further includes an auxiliary feed line coupled between said reclaimed expansion fluid supply line and a spray nozzle installed in fluid communication with said exhaust gas manifold, and being operative to spray a portion of expansion fluid into exhaust gas thereby accelerating cooling of the exhaust gas and condensation of expansion fluid from said exhaust gas.

9. An engine system according to claim 1, wherein said expansion fluid which has been liberated to steam by having increased potential energy as a result of heat transfer from said expander housing is injected into said combustion gas output of said combustor prior to being expanded in said expander, thereby performing mechanical work, which causes rotation of said engine output shaft.

10. An engine system according to claim 1, wherein a portion of said expansion fluid is in a gaseous phase, having increased potential energy, which is injected into said combustion gas output by said combustor subsequent to being liberated into said gaseous phase as a result of heat transfer from the expander housing, and is a component of said expandable working gas, so that said gaseous phase expansion fluid is allowed to expand in said expander, thereby performing mechanical work, which causes rotation of said engine output shaft, and wherein that portion of said expansion fluid which is still in a liquid phase is also injected into said combustion gas and transitions to a gas phase when mixing with said combustion gas.

11. An engine system according to claim 1, wherein said expansion fluid comprises a liquid, which is injected into said combustion gas output of said combustor prior to being liberated into a gaseous phase as a component of said expandable working gas, so that said gaseous phase expansion fluid is allowed to expand in said expander, thereby performing mechanical work, which causes rotation of said engine output shaft.

12. An engine system according to claim 2, said expansion fluid condensation sub-system includes a heat exchanger having an ambient air inlet port coupled to receive intake ambient air, and an air outlet port coupled to said compressor, an exhaust gas inlet port, coupled with said expander exhaust manifold, and an exhaust gas outlet port, and a water condensation accumulator arranged to collect water condensed out of said exhaust gas by heat exchanger.

13. An engine system according to claim 12, wherein said expansion fluid condensation sub-system further includes a water condensation pump and a reclaimed water fluid supply line coupled between said water condensation accumulator and said expander and being operative to recirculate reclaimed water to said expander.

14. An engine system according to claim 13, wherein said water condensation accumulator includes a sump installed at a downstream region of heat exchanger, and wherein said water condensation pump is coupled to said sump, so that accumulated water condensation may be recirculated via said reclaimed water supply line to said expander.

15. An engine system according to claim 14, wherein said reclaimed water supply line is coupled with a filter which is operative to remove contaminants from water being recirculated from said water condensation accumulator to said expander.

16. An engine system according to claim 15, wherein said expansion fluid condensation sub-system further includes an auxiliary water feed line which is coupled between said water supply line and a spray nozzle installed in said exhaust gas manifold, and being operative to spray a portion of water into exhaust gas, thereby accelerating cooling of the exhaust gas and thereby condensation of water from said exhaust gas.

17. An engine system according to claim 16, wherein said heat exchanger comprises a section of thermally conductive material that extends between said air intake port and said air outlet port, said section of thermally conductive material containing a plurality of thermal exchange passageways that extend generally transverse and are in physical contact with said thermally conductive material, said plurality of thermal exchange passageways extending generally vertically and allowing exhaust gas from said exhaust manifold to pass therethrough and be vented to said exhaust gas outlet port.

18. A method of controlling the operation of an engine system having a compressor which is operative to output compressed air, a combustor which is operative to effect continuous combustion of a combustion gas mixture containing fuel and said compressed air and produce a combustion gas output, and an expander to which a mixture of said combustion gas and an expansion fluid is supplied as an expandable working gas, said expander being operative to expand said expandable working gas and perform work which causes rotation of an engine output shaft, each of said compressor and said expander comprising a respective pinned vane type, positive displacement, rotary device, comprising the steps of:

(a) coupling an expansion fluid flow path in thermal communication with a housing of expander rotary device, so that thermal energy within the housing of said expander rotary device is coupled to said expansion fluid flow path, said expansion fluid flow path having an output port disposed adjacent to said combustion gas output port of said combustor;

(b) controllably causing expansion fluid to flow through said expansion fluid flow path to said output port and thereby be combined with said combustion gas as said expandable working gas, such that there is a thermal energy transfer from said housing to said expansion fluid, thereby causing said expansion fluid to absorb thermal energy from the expander housing, and increasing the thermal energy of said expansion fluid that has been supplied to said expansion fluid flow path, and is output from said output port and mixed with said combustion gas as said expandable working gas; and (c) reclaiming, by heat exchange condensation, a portion of expansion fluid contained in exhaust gas produced from said expander and supplying reclaimed expansion fluid to said expander housing for reuse in said method.

19. A method according to claim 18, wherein said expansion fluid contains water.

20. A method according to claim 18, wherein step (c) comprises providing a heat exchanger in a flow path of said exhaust gas from said expander, said heat exchanger having an ambient air inlet port coupled to receive intake ambient air, and an air outlet port coupled to said compressor, an exhaust gas inlet port coupled in fluid communication with an exhaust manifold of said expander, and an exhaust gas outlet port, and coupling an expansion fluid condensation accumulator to said heat exchanger so as to collect expansion fluid condensed out of said exhaust gas by said heat exchanger.

21. A method according to claim 20, wherein step (c) further comprises pumping reclaimed expansion fluid from said condensation accumulator through a reclaimed expansion fluid supply line to said expander.

22. A method according to claim 18, wherein step (c) includes filtering contaminants from reclaimed expansion fluid being supplied to said expander.

23. A method according to claim 20, further including the step (d) of injecting a portion of said expansion fluid into said exhaust gas, thereby accelerating cooling of the exhaust gas and condensing expansion fluid from said exhaust gas.

24. A method according to claim 18, wherein said expansion fluid comprises a gas having increased potential energy subsequent to heating by said expander housing, said gas being injected into said combustion gas output of said combustor, subsequent to being liberated into a gaseous phase and becoming a component of said expandable working gas, so that said gaseous phase expansion fluid is allowed to expand in said expander, thereby performing mechanical work, which causes rotation of said engine output shaft.

25. A method according to claim 18, wherein a portion of said expansion fluid comprises a liquid having increased potential energy subsequent to heating by said expander housing, which is injected into said combustion gas output of said combustor prior to being liberated into a gaseous phase as a component of said expandable working gas, so that said gaseous phase expansion fluid is allowed to expand in said expander, thereby performing mechanical work, which causes rotation of said engine output shaft, and wherein that portion of said expansion fluid which is still in a gaseous phase is also injected into said combustion gas, mixing with said combustion gas, is also allowed to expand in said expander, thereby performing mechanical work.

* * * * *